US006382104B1

(12) United States Patent
Peters

(10) Patent No.: US 6,382,104 B1
(45) Date of Patent: May 7, 2002

(54) TWO-PIECE BASE PAD IGNITER BAG

(75) Inventor: Susan T. Peters, Arlington, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/708,239

(22) Filed: Nov. 7, 2000

(51) Int. Cl.[7] ..... F42B 00/00
(52) U.S. Cl. ..... 102/282
(58) Field of Search ..... 102/282, 430, 102/532, 283, 284

(56) References Cited

U.S. PATENT DOCUMENTS

| | | | | | |
|---|---|---|---|---|---|
| 588,443 | A | * | 8/1897 | Kendall | |
| 864,725 | A | * | 8/1907 | Davis | |
| 3,771,460 | A | * | 11/1973 | Ayer | |
| 4,505,201 | A | | 3/1985 | Abele | 102/324 |
| 4,702,167 | A | * | 10/1987 | Reinelt et al. | |
| 4,864,932 | A | * | 9/1989 | Reinelt et al. | |
| 4,887,534 | A | | 12/1989 | Dickovich et al. | 102/373 |
| 5,052,304 | A | * | 10/1991 | Rahnenfuhrer et al. | |
| 5,063,848 | A | | 11/1991 | Tucker et al. | 102/282 |
| 5,090,323 | A | | 2/1992 | Kallevig et al. | 102/282 |
| H1087 | H | | 8/1992 | Sullivan | 156/153 |
| 5,269,224 | A | * | 12/1993 | Gonzales et al. | |
| 5,454,323 | A | * | 10/1995 | Conil | |
| 5,672,842 | A | * | 9/1997 | Brion et al. | |
| 5,747,723 | A | | 5/1998 | Buckalew et al. | 102/282 |

FOREIGN PATENT DOCUMENTS

| | | | |
|---|---|---|---|
| DE | 304218 | * | 4/1920 |
| FR | 692609 | * | 3/1930 |

* cited by examiner

*Primary Examiner*—Peter M. Poon
*Assistant Examiner*—Troy Chambers
(74) *Attorney, Agent, or Firm*—Mark Homer

(57) ABSTRACT

A method of making an igniter bag includes (a) providing a first piece of material having a shape of two substantially identical semicircular portions connected along their straight edges by a substantially rectangular portion; the shape defining two opposing three-sided notches, one notch on either side of the rectangular portion; (b) providing a second piece of material having substantially the same shape as the first piece of material; (c) aligning the first piece of material on top of the second piece of material; (d) joining the first and second pieces of material along the three sides of each of the opposing notches; (e) folding the first piece of material such that circumferences of its two substantially identical semicircular portions are aligned with each other and folding the second piece of material such that circumferences of its two substantially identical semicircular portions are aligned with each other; and (f) joining the circumferences of the two substantially identical semicircular portions of the first piece and joining the circumferences of the two substantially identical semicircular portions of the second piece while leaving an opening in one of the first and second pieces.

15 Claims, 2 Drawing Sheets

TWO-PIECE BASE PAD IGNITER BAG

STATEMENT OF GOVERNMENT INTEREST

The invention described herein may be manufactured and used by or for the Government of the United States of America for government purposes without the payment of any royalties therefor.

BACKGROUND OF THE INVENTION

The invention in general relates to igniter bags, and in particular to igniter bags used to ignite stick propellant.

FIG. 1 schematically shows an example of the environment wherein a base pad igniter bag is used. A barrel 10 contains a projectile 12 that rests on a metal cartridge case 14. Case 14 is closed at its upper end by a polyurethane plug 16. Case 14 is filled with stick propellant 18. A case base 20 closes the lower end of the case 14. A stub igniter 22 is disposed centrally in the case base 20. A base pad igniter bag 24 fits in the cupped region of the case base 20.

Base pad igniter bag 24 is typically shaped like a doughnut to fit around stub igniter 22. Igniter bag 24 is generally sewn from clean-burning cloth and filled with a granular igniter material 26. Igniter bag 24 transfers the ignition from stub igniter 22 to the stick propellant 18. Initially, stub igniter 22 is ignited and it transfers its combustion products radially through openings 28 into the igniter bag 24. The combustion products from the igniter bag 24 vent into the stick propellant 18, igniting the ends of the sticks and flowing through the channels between the sticks to ignite their other surfaces.

FIG. 2 schematically shows a prior two-piece igniter bag 30 with a seam at the inner circumference 32. The bag of FIG. 2 is made by sewing two identically shaped pieces of material together along their inner and outer circumferences 32, 34. The design of FIG. 2 offers no real surface area normal to the venting gases from the stub igniter. This lack of intimate contact between the stub igniter and the igniter bag leads to excessive ignition delays. Providing more intimate contact is the object of the bag shown in FIG. 3.

FIG. 3 schematically shows a three-piece igniter bag 40 in which a separate flat piece 42 is sewn like a sleeve between the two doughnut shaped pieces of material. While better ignition is achieved, the bag of FIG. 3 takes much longer to make because of the difficult seam between the straight sleeve 42 and the two doughnut shaped main pieces. The small radius, on the order of two centimeters, is very extreme and difficult to sew by machine. In addition, the fabric bulk of the seam allowances is still in the critical region next to the stub igniter vents, so ignition transfer difficulties may be experienced.

SUMMARY OF THE INVENTION

The igniter bag of the present invention uses only two pieces of cloth, but retains the sleeve effect to achieve reliable ignition transfer to the igniter material contained in the bag. Seams are either straight or have a considerably larger radius of about 6 centimeters and are easier to sew. Furthermore, most seam allowance bulk is on the flat surface of the pad rather than near the interface with the stub igniter. Only two short, axial seams break the surface presented to the stub igniter.

BRIEF DESCRIPTION OF THE DRAWINGS

The invention will be better understood, and further objects, features, and advantages thereof will become more apparent from the following description of the preferred embodiments, taken in conjunction with the accompanying drawings in which.

DETAILED DESCRIPTION OF THE PREFERRED EMBODIMENTS

Figure 1:
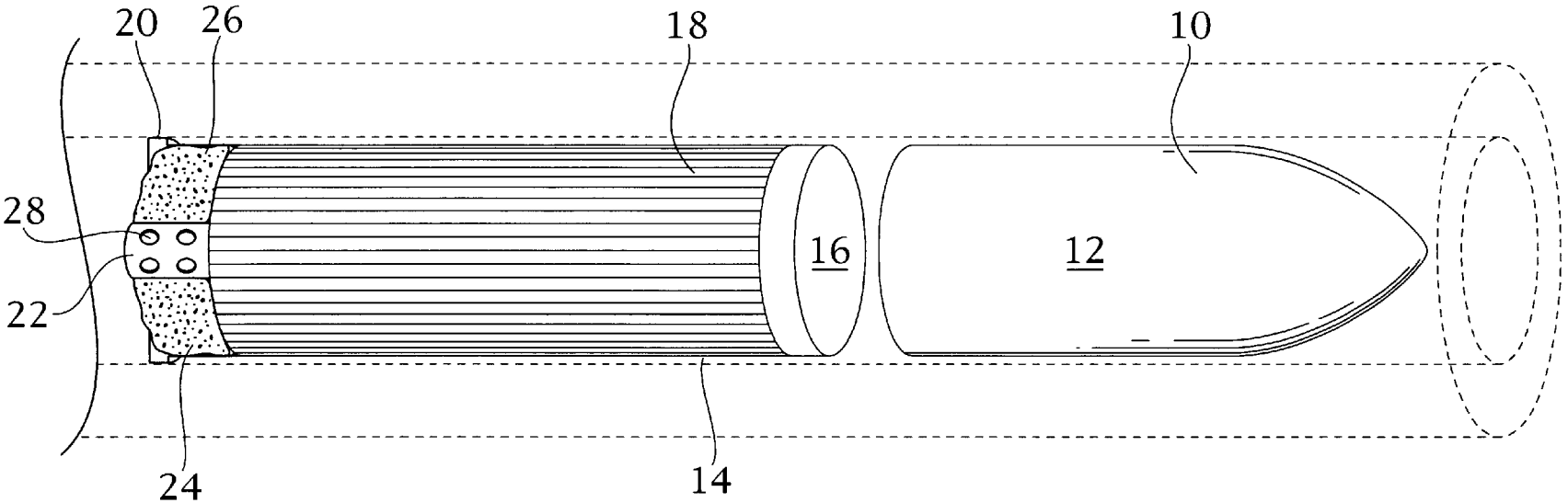
FIG. 1 schematically shows an exemplary environment in which the igniter bag of the present invention may be used.
Figure 3:
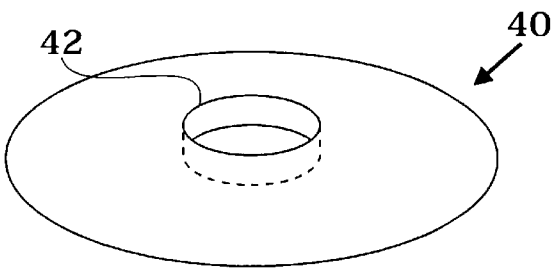
Fig 3 Prior Art
FIGS. 2 and 3 schematically show prior art igniter bags.

In the drawings, which are not necessarily to scale, like or corresponding parts are denoted by like or corresponding reference numerals.

Figure 4:
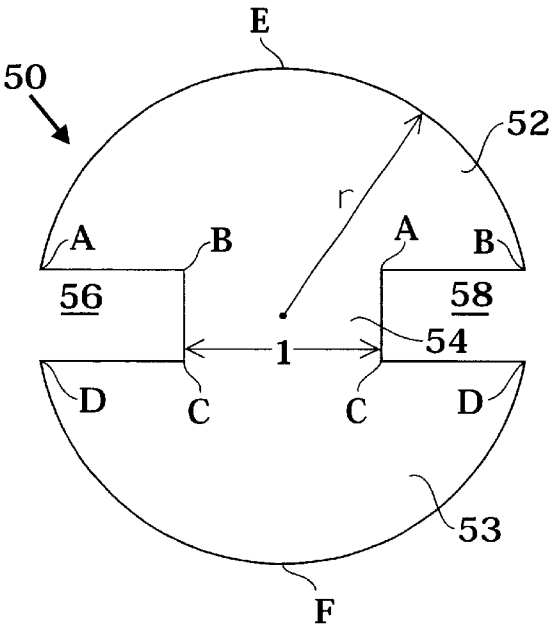
FIG. 4 shows the shape of the material that is used to make the igniter bag of the present invention.

FIG. 4 shows the shape 50 of the material that is used to make the igniter bag 60 (FIG. 5) of the present invention. To make the present invention, two pieces of material are cut in the form shown in FIG. 4. That is, each piece of material has a shape 50 of two substantially identical semicircular portions 52, 53 connected along their straight edges by a substantially rectangular portion 54. The shape 50 defines two opposing three-sided notches 56, 58, with one notch on either side of the rectangular portion 54. Silk or acrylic rayon are appropriate materials for the igniter bag because they burn without leaving residue.

One piece of material is aligned on top of the other piece of material. The two pieces of material are joined along the three sides of each of the opposing notches 56, 58. That is, the two pieces are joined at notch 56 along sides AB, BC and CD. Similarly, the two pieces are joined at notch 58 along sides AB, AC and CD. The pieces are preferably joined by stitching.

The top piece of material is folded such that the circumferences of its two substantially identical semicircular portions 52, 53 are aligned with each other. That is, circumference AEB becomes aligned with circumference DFD and points E and F meet each other. The bottom piece of material (located directly beneath the top piece) is similarly folded such that the circumferences of its two substantially identical semicircular portions are aligned with each other. The circumferences of the two substantially identical semicircular portions of the top piece are joined, preferably by stitching, and the circumferences of the two substantially identical semicircular portions of the bottom piece are joined, preferably by stitching. An opening (about two centimeters, for example) is left in one of the two pieces for filling the bag with igniter material.

Long thread tails (about 20 centimeters) may be left and used to sew loose hand stitches across the opening. These will be pulled tight after the bag is filled with igniter material. The filled bag, when placed in the case base around a stub igniter, will not lay flat. The opening may also be closed by gluing or taping.

In a preferred embodiment, radii r of the two substantially identical semicircular portions 52, 53 are about 1.2 times a length l of the substantially rectangular portion 54. Additionally, radii r of the two substantially identical semicircular portions 52, 53 are about 2.4 times a width w of the substantially rectangular portion 54.

Figure 5:
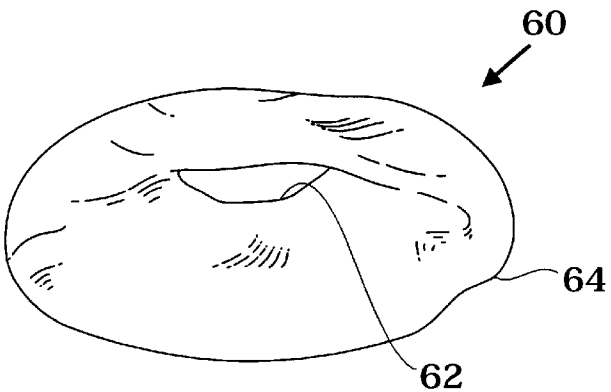
FIG. 5 is a perspective view of an igniter bag according to the invention.
Figure 2:
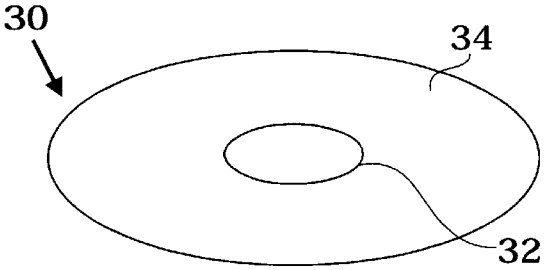
Fig 2 Prior Art

FIG. 5 is a perspective view of an igniter bag 60 according to the invention. Opening 62 is where the stub igniter is located. The bottom periphery 64 corresponds to the stitched circumferences of the two substantially identical semicircular portions of the top piece and the bottom piece. The present invention is much simpler to make than the previous three-piece design, thereby reducing cost. The lack of seam bulk in the critical region adjacent to the stub igniter vents keeps the surface flat and almost free of seam allowance bulk, thereby promoting prompt, reliable ignition transfer.

The present invention could also be made from a heat-sealable film, in which case the seams would be sewn melted together rather than sewn. Closure of the opening after filling with igniter material would be done with tape to avoid an explosive safety problem.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A method of making an igniter bag, comprising:

(a) providing a first piece of material having a shape of two substantially identical semicircular portions connected along their straight edges by a substantially rectangular portion; the shape defining two opposing three-sided notches, one notch on either side of the rectangular portion;

(b) providing a second piece of material having substantially the same shape as the first piece of material;

(c) aligning the first piece of material on top of the second piece of material;

(d) joining the first and second pieces of material along the three sides of each of the opposing notches, forming a first opening wherein an igniter may be placed therein;

(e) folding the first piece of material such that circumferences of its two substantially identical semicircular portions are aligned with each other and folding the second piece of material such that circumferences of its two substantially identical semicircular portions are aligned with each other; and (f) joining the circumferences of the two substantially identical semicircular portions of the first piece and joining the circumferences of the two substantially identical semicircular portions of the second piece while leaving an opening in one of the first and second pieces.

2. The method of claim 1 wherein the joining in steps (d) and (f) comprises stitching.

3. The method of claim 2 wherein the first and second pieces of material comprise one of silk and acrylic rayon.

4. The method of claim 1 further comprising, (g) filling the bag with igniter material through the opening in one of the first and second pieces.

5. The method of claim 4 further comprising, (h) closing the opening.

6. The method of claim 5 wherein the opening is closed by one of gluing, taping and stitching.

7. The method of claim 1 wherein the first and second pieces of material comprise heat sealable film and the joining in steps (d) and (f) comprises heat sealing.

8. The method of claim 1 wherein in step (a) radii of the two substantially identical semicircular portions are about 1.2 times a length of the substantially rectangular portion.

9. The method of claim 8 wherein in step (a) radii of the two substantially identical semicircular portions are about 2.4 times a width of the substantially rectangular portion.

10. An igniter bag, comprising:

a first piece of material having a shape of two substantially identical semicircular portions connected along their straight edges by a substantially rectangular portion; the shape defining two opposing three-sided notches, one notch on either side of the rectangular portion;

a second piece of material having substantially the same shape as the first piece of material;

a stitching joining the first and second pieces of material along the three sides of each of the opposing notches, forming a first opening wherein an igniter may be placed therein;

a stitching joining the circumferences of the two substantially identical semicircular portions of the first piece and a stitching joining the circumferences of the two substantially identical semicircular portions of the second piece while leaving an opening in one of the first and second pieces.

11. The igniter bag of claim 10 further comprising igniter material disposed in the igniter bag.

12. The igniter bag of claim 11 further comprising one of a stitching, tape and glue for closing the opening.

13. The igniter bag of claim 10 wherein the first and second pieces of material comprise one of silk and acrylic rayon.

14. The igniter bag of claim 10 wherein radii of the two substantially identical semicircular portions are about 1.2 times a length of the substantially rectangular portion.

15. The igniter bag of claim 14 wherein radii of the two substantially identical semicircular portions are about 2.4 times a width of the substantially rectangular portion.

* * * * *